US008615947B2

(12) United States Patent
Underkofler et al.

(10) Patent No.: US 8,615,947 B2
(45) Date of Patent: Dec. 31, 2013

(54) TWO-PIECE MODULAR YOKE

(75) Inventors: Abraham M. Underkofler, Waukegan, IL (US); Peder J. Gulbrandsen, Aurora, IL (US); Mark R. Paulsen, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/488,474

(22) Filed: Jun. 5, 2012

(65) Prior Publication Data

US 2013/0318905 A1 Dec. 5, 2013

(51) Int. Cl.
*E04B 2/00* (2006.01)

(52) U.S. Cl.
USPC ..... 52/506.06; 52/220.6; 52/506.07; 52/506.08; 248/317; 248/323; 248/324

(58) Field of Classification Search
USPC ..... 52/220.6, 506.01, 506.05, 506.06, 52/506.07, 506.08, 509, 512; 248/317, 248/323, 324
See application file for complete search history.

(56) References Cited

U.S. PATENT DOCUMENTS

| | | | | | |
|---|---|---|---|---|---|
| 3,374,596 | A * | 3/1968 | O'Brien et al. | 52/664 |
| 3,640,042 | A * | 2/1972 | Kidney | 52/506.09 |
| 3,746,379 | A * | 7/1973 | Sauer | 403/2 |
| 4,015,811 | A | 4/1977 | Nute, Jr. et al. | |
| 4,064,671 | A * | 12/1977 | Sauer | 52/696 |
| 4,723,749 | A * | 2/1988 | Carraro et al. | 248/317 |
| 4,905,952 | A * | 3/1990 | Pinquist | 248/317 |
| 5,482,240 | A * | 1/1996 | Caraher | 248/297.51 |
| 6,138,416 | A * | 10/2000 | Platt | 52/28 |
| 6,205,733 | B1 * | 3/2001 | LaLonde | 52/506.07 |
| 6,298,623 | B1 * | 10/2001 | Wendt | 52/506.06 |
| 6,341,466 | B1 * | 1/2002 | Kehoe et al. | 52/712 |
| 6,345,800 | B1 * | 2/2002 | Herst et al. | 248/342 |
| 6,374,564 | B1 * | 4/2002 | Fletterick et al. | 52/506.07 |
| 7,264,214 | B2 * | 9/2007 | Oh | 248/342 |
| 7,478,787 | B2 * | 1/2009 | Bankston et al. | 248/343 |
| 7,506,845 | B2 * | 3/2009 | Oh | 248/73 |
| 7,634,881 | B2 * | 12/2009 | Ahren et al. | 52/506.06 |
| D608,619 | S * | 1/2010 | Gulbrandsen et al. | D8/354 |
| 7,658,047 | B2 * | 2/2010 | Bankston et al. | 52/506.07 |
| 7,661,236 | B2 * | 2/2010 | Platt et al. | 52/506.06 |

(Continued)

FOREIGN PATENT DOCUMENTS

| | | |
|---|---|---|
| BE | 1 001 827 A3 | 3/1990 |
| DE | 20 2006 003729 U1 | 6/2006 |
| EP | 0 173 359 A2 | 3/1986 |

OTHER PUBLICATIONS

Notification of Transmittal of the International Search Report and the Written Opinion of the International Searching Authority, or the Declaration mailed Aug. 21, 2013; International Search Report dated Aug. 21, 2013; Written Opinion of the International Searching Authority.

*Primary Examiner* — Basil Katcheves
*Assistant Examiner* — Joshua Ihezie
(74) *Attorney, Agent, or Firm* — Pearne & Gordon LLP

(57) ABSTRACT

A sheet metal yoke for supporting a pair of main runners of a suspended ceiling grid in parallel alignment with a relatively narrow spacing, the yoke having an inverted U-shape with a horizontal span and a depending leg adjacent each end of the span, a lower end of each leg having a tab extending towards the other leg, the tab being proportioned to fit in a cross runner slot of a main runner and being capable of vertically supporting the main runner at a desired elevation.

7 Claims, 3 Drawing Sheets

(56) References Cited

U.S. PATENT DOCUMENTS

| | | | | |
|---|---|---|---|---|
| 7,735,794 | B1 * | 6/2010 | Gretz | 248/343 |
| 7,784,754 | B2 * | 8/2010 | Nevers et al. | 248/200.1 |
| 7,810,775 | B2 * | 10/2010 | Dal Ponte et al. | 248/343 |
| 7,878,464 | B2 * | 2/2011 | Oh | 248/65 |
| 8,087,631 | B1 * | 1/2012 | Gretz | 248/326 |
| 8,091,721 | B1 * | 1/2012 | Gretz | 220/3.9 |
| 8,109,482 | B2 * | 2/2012 | Oh | 248/342 |
| 8,177,176 | B2 * | 5/2012 | Nguyen et al. | 248/200.1 |
| 8,336,843 | B2 * | 12/2012 | Gulbrandsen et al. | 248/317 |
| 8,338,719 | B2 * | 12/2012 | Lehane et al. | 174/480 |
| 2004/0159064 | A1 * | 8/2004 | Okumura | 52/506.06 |
| 2005/0247842 | A1 * | 11/2005 | Wronski | 248/323 |
| 2007/0075206 | A1 | 4/2007 | Wright et al. | |
| 2008/0155916 | A1 * | 7/2008 | Bankston et al. | 52/220.6 |
| 2008/0184644 | A1 * | 8/2008 | Bankston et al. | 52/506.06 |
| 2010/0139190 | A1 * | 6/2010 | Lehane et al. | 52/220.6 |

* cited by examiner

TWO-PIECE MODULAR YOKE

BACKGROUND OF THE INVENTION

The invention relates to suspended ceiling systems and, in particular, to a novel yoke for suspending a pair of main runners in parallel relation.

PRIOR ART

Certain ceiling treatments or designs utilize main runners or tees in relatively closely spaced pairs to give a ceiling a distinctive appearance and/or to provide an intermediate space for lighting, HVAC systems, sprinkler systems, and like services. It is known to use inverted U-shaped brackets or yokes to support a pair of main runners in close parallel relation. Such brackets, typically, are suspended in the customary manner that the remainder of the suspension grid is carried. Prior art yoke designs involve somewhat tedious installation procedures and/or are limited to single channel widths.

SUMMARY OF THE INVENTION

The invention provides an improved yoke for spacing main runners in a suspended ceiling grid to form relatively narrow utility channels. The yoke includes mounting tabs that are arranged to be received in the cross runner slots existing in the main runners. The mounting tabs afford quick initial mounting of the main runners without tools, clamps and other instrumentalities. The yoke includes a catch that allows a runner to be received on the tab when the runner is twisted about its length and resists release of the runner from the tab when the runner is allowed to assume a normal orientation.

In its preferred embodiment, the yoke is assembled from two identical pieces. The pieces are lapped and screwed together by the installer. The two piece construction enables the yoke to be adjustable to the desired channel width between the main runners. The disclosed yoke, besides simplifying the installation of main runners for the tradesman, offers benefits to a manufacturer, distributors and contractors. One yoke fits commonly used utility channel sizes. Thus, inventory is greatly simplified for those engaged in the supply chain or is a contractor.

DESCRIPTION OF THE PREFERRED EMBODIMENT

Figure 1:
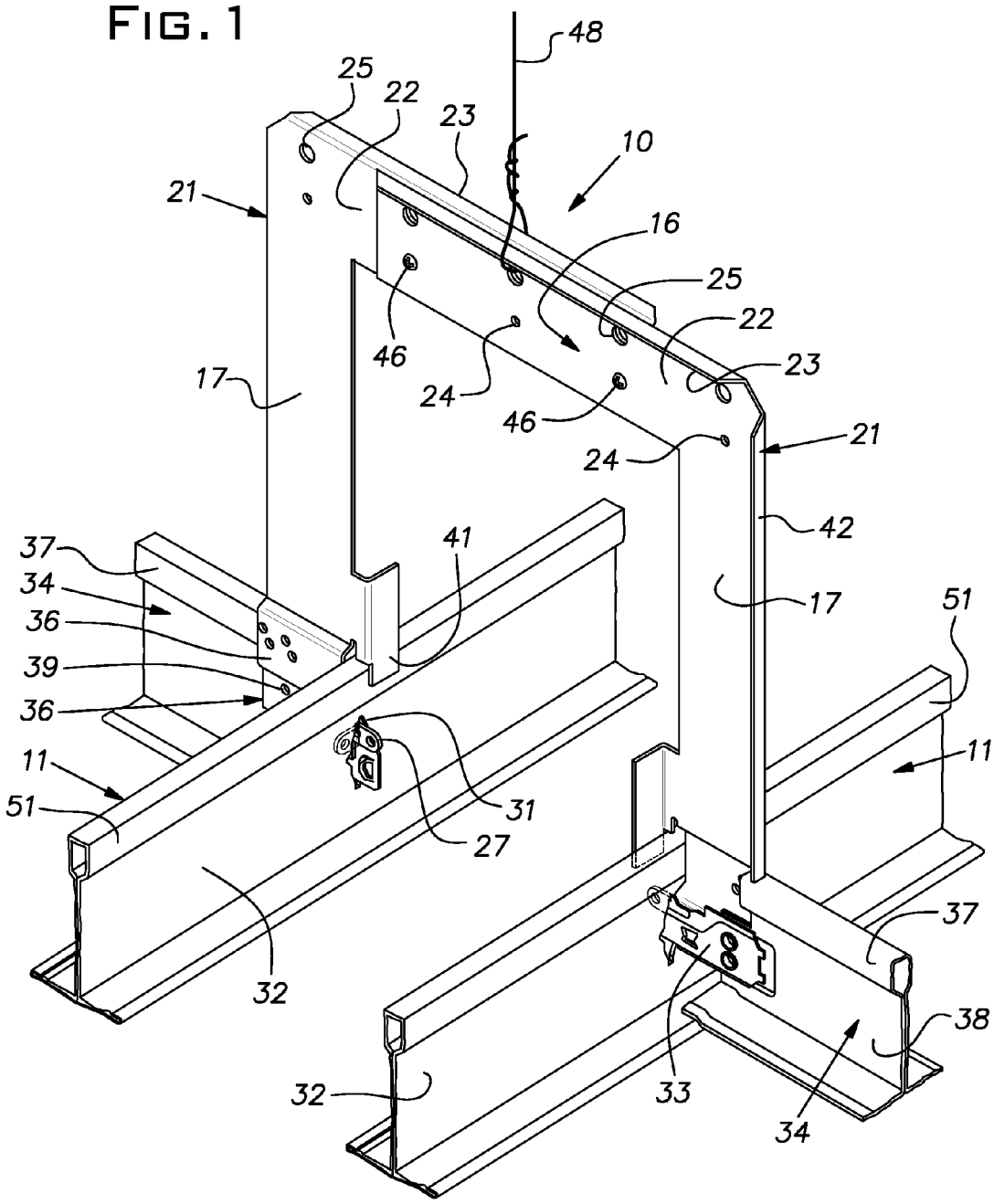
FIG. 1 is a perspective view of a yoke of the invention shown assembled with local areas of a pair of parallel main runners.

A yoke 10 shown in FIG. 1 supports a pair of main grid runners 11 at a desired spacing to provide a relatively narrow utility channel between the runners. The channel formed between the runners 11 can be used to integrate lights, air vents, speakers, and other devices or services into a grid of like main and cross runners of a suspended ceiling. The illustrated grid runners 11 are of the familiar inverted tee cross section, but can have other known cross sectional shapes. The channel width is relatively narrow compared to the normal spacing used with main runners.

The yoke 10 is used with additional identical yokes spaced along the length of the main runners 11 which length, typically, is 12 ft. The yoke 10 has the general shape of an inverted U with an upper horizontal span 16 and depending legs 17 adjacent the ends of the span. As later indicated, the spacing between the legs 17 determines the relative spacing between the main runners 11.

Preferably the yoke 10 is an assembly of two identical parts 21. A part 21 is generally L-shaped, i.e. its shape is primarily that of a right angle. Ideally, the part 21 is stamped of sheet metal, usually galvanized steel. A major portion of the part 21 remains planar. An upper arm 22 of the part 21 is generally flat, apart from a narrow flange 23 along its upper edge at a right angle to the plane of the arm proper. A parallel series of spaced small and large holes 24, 25 are punched along the length of the arm 22.

Figure 3:
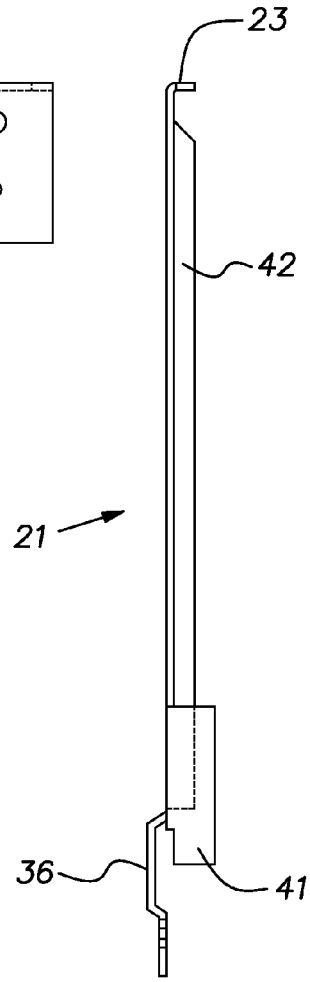
FIG. 3 is an edge view of the one part of the yoke.

Adjacent a lower end 26, the leg 17 includes a tab 27 projecting in parallel to the overlying arm 22. At a vertical line 28 where the tab 27 merges with the lower end 26 of the leg 17, a hole 29 is stamped to weaken the part for purposes of enabling and controlling manual bending of the tab as will be discussed. The tab 27 has a vertical height and a thickness enabling it to be received in a cross runner slot 31 in a web 32 of a main runner 11 while leaving sufficient room in the slot for a connector 33 of a cross runner 34. The leg 17, above the tab 27, has an offset portion 36 that lies in a vertical plane horizontally displaced from the plane of a major part of the leg that exists above this portion. It will be seen from FIG. 3 that the tab 27 lies in a plane parallel and immediately adjacent the plane of the upper part of the leg 17. The offset of the portion 36 from the plane of the upper leg portion corresponds to half the width of a reinforcing bulb 37 of a cross runner 34. This offset geometry allows the leg 17 to support a cross runner 34 at a central or medial vertical plane of the cross runner thereby assuring that these elements tend to hang vertically. The lower end 26 of the leg 17 is adapted to abut a web 38 of a cross runner 34 and has a hole 39 for receiving a screw to fasten this end to the abutting web.

Spaced above the tab 27, the leg 17 has a portion bent into a transverse plane and forming a catch or hook 41. A vertical edge of the leg 17 is bent to form a small stiffening flange 42.

FIG. 1 illustrates a pair of the right angle parts 21 held by lapping their respective upper arms 22 and assembled in position by driving screws 46 or inserting rivets in the preformed small holes 24. The holes 24 are located in their respective parts to permit adjustment to a standard channel width when a hole or holes of one part 21 are registered with the hole or holes of the other part 21. The thus assembled yoke 10 is configured to support a pair of main runners 11 at a space corresponding to a standard channel width of, for example, 2 in., 4 in., 6 in., and 8 in. Ordinarily, a pair of main runners 11 will be supported by several yokes 10 spaced along the length of the runners. An installer, typically, will assemble the required number of yokes 10 each adjusted to a specific channel width and hang them with suspension wires 48 from overhead structure. The larger holes 25 are provided to receive the suspension wires 48. Ideally, the holes 25 are large enough to accept multiple wires where splay wire type applications are desired or required such as in seismic applications.

Figure 1A:
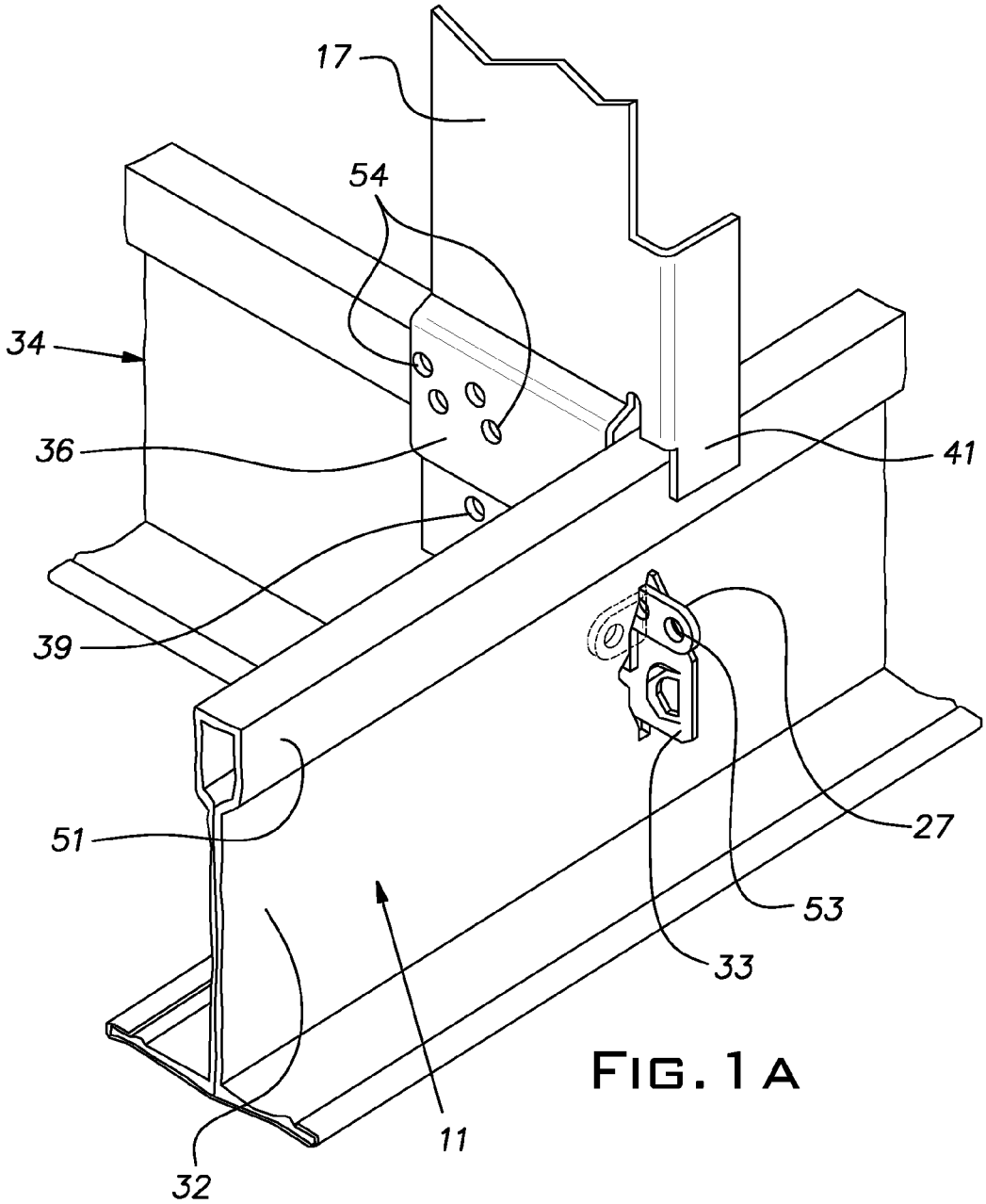
FIG. 1A is a fragmentary view similar to FIG. 1 showing certain details of the yoke and main runner assembly.
Figure 2:
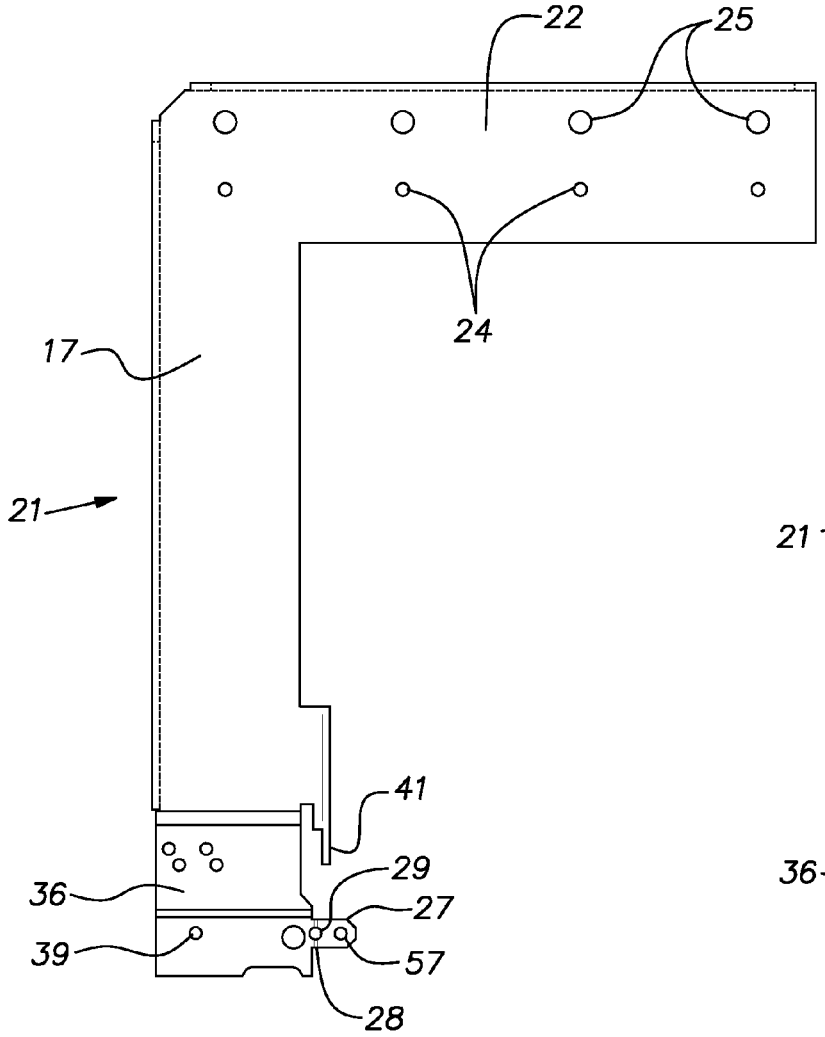
FIG. 2 is an elevational view of one part of the yoke.

A main runner 11 is installed on a yoke 10 by holding the runner between the legs 17 and twisting it about its longitudinal axis so that the reinforcing bulb, designated 51 at the top of the runner is tilted toward the side of the yoke to which it is to be mounted. With the runner 11 tilted, the bulb 51 is slipped under the catch 41. With a cross runner slot 31, aligned with a tab 27, the runner is turned upright so that the tab enters and extends through the cross runner slot. At this stage, at least the local section of the main runner 11 is fully supported on the respective yoke 10. It will be appreciated that this mounting is accomplished without the use of tools or fixtures. The tab 27 can be manually bent back against the web 32 of the main runner 11 (to the left in FIG. 1A) immediately or after tabs 27 of other yokes 10 are deployed in respective cross runner slots 31.

Once a main runner 11 is installed on a number of yokes 10, cross runners can be assembled on it. The other main runner 11 to be assembled on a yoke can be installed before or after cross runners 34 are installed on the first placed main runner 11. At some point, typically before any nearby ceiling panels are installed, the tabs 27 can be secured to main runner webs 32 with screws run through tab holes 53. Likewise, screws can fix the legs 17 to the cross runner webs 38 at the provided holes 39 and to the cross runner reinforcing bulb at selected ones of the provided holes, designated 54.

When the yokes 10 associated with a pair of main runners 11 are secured to the main runner webs 32 and the cross runner webs 38 and reinforcing bulbs 37 with fasteners in the provided holes, a relatively rigid structure results. The rigidity is very helpful to the installer when uneven loads are imposed on a suspended grid and forces tend to distort it out of a plane. This phenomena, when using prior art yokes, hindered the installer and often required him to reset the grid. The slim profile of the yoke 10, seen in FIG. 3, reduces potential interference with components to be carried in the channel formed by the main runners 11.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A sheet metal yoke for supporting a pair of main runners of a suspended ceiling grid in parallel alignment with a relatively narrow spacing, the yoke having an inverted U-shape with a horizontal span and a depending leg adjacent each end of the span, a lower end of each leg having a tab extending towards the other leg, the tab being arranged to fit in a cross runner slot of a respective one of said pair of main runners and being capable of vertically supporting the one main runner at a desired elevation, each leg having a depending catch comprising an integrally connected vertical element that extends perpendicularly to the leg, a zone between the catch and the leg configured to receive a reinforcing bulb of the main runners, the catch being arranged to restrain a main runner from falling off an associated one of said tabs when said one tab is received in a cross runner slot and when the main runner is vertically oriented, the tab having a vertical fold line established by a weakened zone whereby the tab can be permanently bent towards a web of the main runner to lock the main runner on the yoke.

2. A yoke as set forth in claim 1, wherein the tab has a hole for receiving a screw for securing the tab against the main runner web.

3. A yoke as set forth in claim 1, wherein the legs have offset sections that receive a portion of the width of a reinforcing bulb of a cross runner, the offset sections enabling the legs to support a cross runner at a central plane of the cross runner.

4. A yoke as set forth in claim 1, wherein the span is formed by identical arm sections of L-shaped parts, the identical sections having alignable holes for receiving assembly screws and/or suspension wires.

5. A yoke as set forth in claim 1, wherein a spacing between the depending legs is adjustable to provide a desired spacing between the pair of main runners being supported by the yoke.

6. A yoke as set forth in claim 5, wherein the adjustment of the leg spacing is afforded by a series of holes in the span.

7. A sheet metal yoke for supporting a pair of main runners of a suspended ceiling grid in parallel alignment with a relatively narrow spacing, the yoke having an inverted U-shape with a horizontal span and a depending leg adjacent each end of the span, a lower end of each leg having a tab extending towards the other leg, the tab being proportioned to fit in a cross runner slot of a main runner and being capable of vertically supporting the main runner at a desired elevation, comprising two identical L-shaped parts, the L-shaped parts when assembled together each having elements mutually forming said horizontal span, the horizontal span forming elements being formed with mutually indexable fastener receiving holes having predetermined locations corresponding to multiple yoke widths, the L-shaped parts having portions bent out of a plane of the sheet metal, when assembled together the L-shaped parts having their respective bent portions extending in opposite directions with respect to a plane of the yoke.

* * * * *